United States Patent [19]

Islava et al.

[11] Patent Number: 4,867,275

[45] Date of Patent: Sep. 19, 1989

[54] ESCAPE LADDER

[76] Inventors: Steven T. Islava, 1600 Coral Pl.; John G. Cazort, III, 1902 Clay St., both of Newport Beach, Calif. 92663

[21] Appl. No.: 190,420

[22] Filed: May 5, 1988

[51] Int. Cl.[4] ..... E06C 1/36; E06C 1/58

[52] U.S. Cl. ..... 182/198; 182/206

[58] Field of Search ..... 182/206, 196, 197, 198, 182/163, 41, 40

[56] References Cited

U.S. PATENT DOCUMENTS

| | | | |
|---|---|---|---|
| 1,196,419 | 8/1916 | Banyovitz | 182/164 |
| 3,385,399 | 5/1968 | Burt | 182/206 |
| 3,858,683 | 1/1975 | Rachocki | 182/206 |
| 3,907,604 | 9/1975 | Svalberg | 182/206 |
| 4,243,121 | 1/1981 | Kiss | 182/206 |
| 4,709,783 | 12/1987 | Tomioka | 182/198 |

FOREIGN PATENT DOCUMENTS 751948 7/1980 U.S.S.R. .

*Primary Examiner*—Reinaldo P. Machado
*Attorney, Agent, or Firm*—John E. Wagner

[57] ABSTRACT

An escape ladder for side rails with multilevel dwellings comprising a pair of side rails with inverted "J" hooks which are pivotal outward to engage a window sill and inward to fold. The side rails extend downward sufficiently to support two or three more steps. Extendable below the rigid portion of the ladder are a second set of steps supported by a flexible support means such as rope with intermediate spacers between steps. Upon applying pressure to the upper one of the second set of steps, the lower portion of the ladder is rigidified. The ladder, after use, may be folded and stored in a bag with the hooks used as handles.

15 Claims, 5 Drawing Sheets

ESCAPE LADDER

BACKGROUND OF THE INVENTION

For many years fire departments around tne country have encouraged the public to become more aware of the dangers of residential fires and to take preventative steps in minimizing fire risks. Likewise, fire safety education for all family members in the event of a fire has been stressed. An evacuation plan and planned escape routes constitute important aspects of family fire safety.

The expanded use of smoke detectors has been a major step forward in alerting occupants or residents of a beginning fire. Statistics have shown that the most dangerous type of residential fire is one which occurs during the sleeping hours. This is true particularly in multilevel residences where the sleeping rooms are characteristically on upper levels. Often a fire begins on the lower level and reaches an upper level before discovery so that the access to lower level escape routes is blocked by flames, smoke, or sometimes, toxic fumes. The answer to such fire dangers is some form of escape device from upper levels such as a fire escape, a ladder or escape rope.

Fire escapes are present in many older buildings but are not usually found in two story residences. For such structures, resort is often made to a makeshift rope ladder in the form of knotted rope secured to a heavy piece of furniture and stored beneath the bed. One form of escape ladder employs a pair of hook members and a series of steps on chains. These lack any rigidity and like any chain, can entangle. Some folding link type ladders have been developed but they tend to be large and bulky and not easily stored where needed.

It has been determined by us that the basic structure of a ladder which allows both feet to be placed firmly on treads is superior to each of the other types of escape devices, particularly if it exhibits a degree of rigidity, whereby the user is immediately aware of its mode of operation, may be installed virtually instantly and provides the solid footing and handgrip with which he associates a ladder.

As an ancillary requirement, the ladder must be easily storable in its room of intended use. Also, it must be effective and obvious in its application and not requiring any reading of instructions for use and virtually automatic in positioning.

BRIEF STATEMENT OF THE INVENTION

To meet these objectives, we developed a collapsable and storable ladder which includes a pair of rigid side rails of inverted "J" shape designed to fit over an open window sill and hook securely regardless of the size of the sill. The side rails are joined by at least two and preferably three or four steps rigidly positioned on the side rails. The side rails themselves are pivotal to reduce the overall width for storage however provide a short rigid ladder similar to a boat ladder.

However, extending below a rigid ladder section are a plurality of steps separated by spacers and suspended on a flexible support medium such as a rope. The spacer members engage the steps to rigidify them when weight is placed upon tne upper surface of any such step. The spacer members and steps are correlated in size to allow spacing comparable to the rigid steps above when in use and allow for neatly folding together to provide a compact, storable ladder. Certain of the steps include standoff members which hold the steps away from the structure to insure that the foot properly engages the step during descent.

When not in use, the ladder assembly may be stored in a bag with the converted "J" hanger portions acting as handles after being pivoted inwardly, and the flexible steps, spacers and rope support means folded adjacent to the rigidly supported steps.

BRIEF DESCRIPTION OF THE DRAWING

This invention may be more clearly understood from the following detailed description and by reference to the drawing in which.

DETAILED DESCRIPTION OF THE INVENTION

Figure 1:
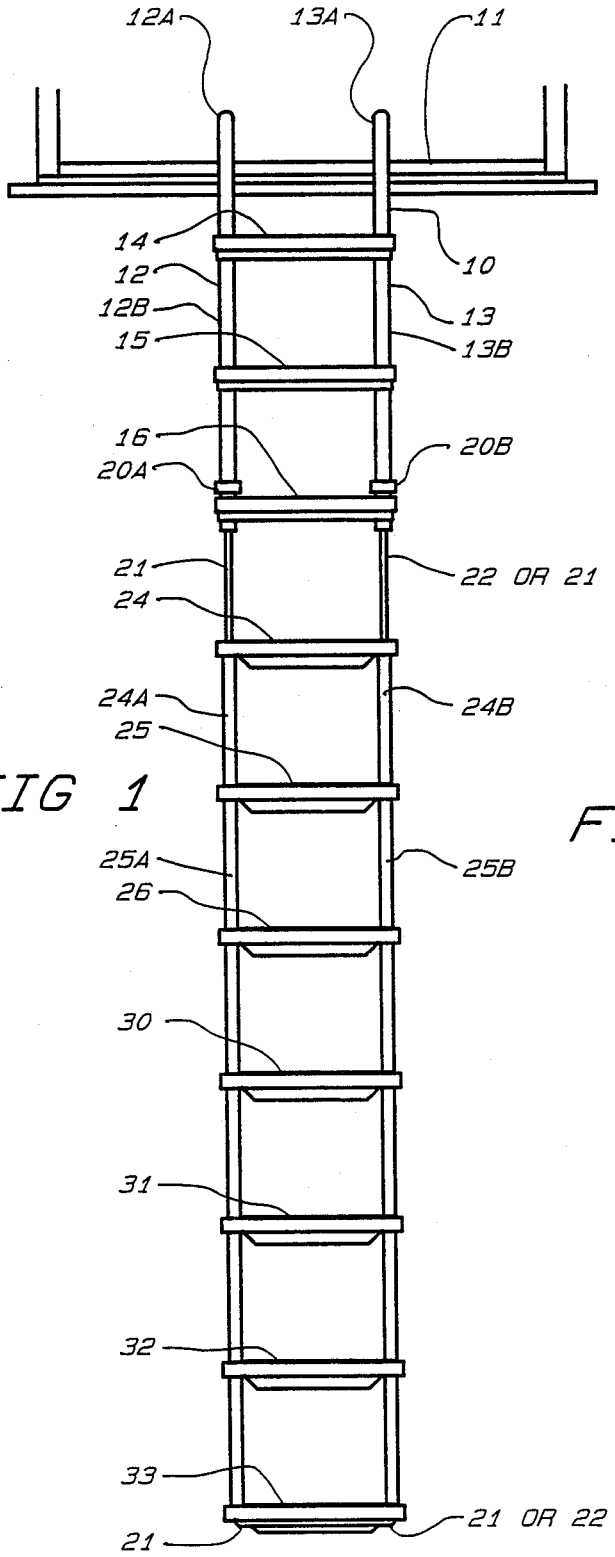
FIG. 1 is a front elevational view of the escape ladder of this invention, in use.
Figure 2:
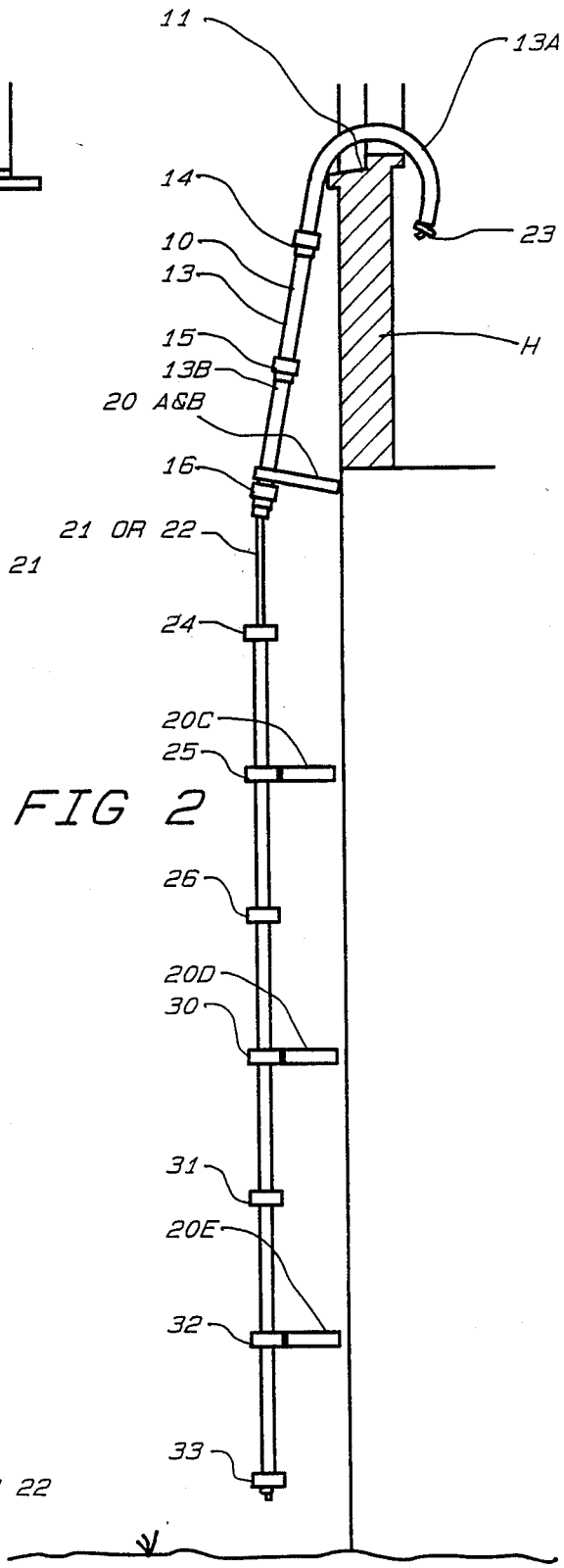
FIG. 2 is a side elevational view thereof with portions of a housing structure shown in section.

Now referring to FIGS. 1 and 2, an escape ladder, generally designated 10, is shown therein positioned over a window sill 11 of a multistory house or structure H. The escape ladder 10 includes a pair of side rails 12 and 13 in inverted "J" shape with a hook portion 12A or 13A respectively and an extended rail portion 12B or 13B. The side rails 12 and 13 are preferably of hollow tubing such as Type 6063 aluminum tubing with a diameter of 1.0 inch and wall thickness of 0.062 inch. Pivotally secured to the side rails 12 and 13 are a plurality, for example, 3 steps 14, 15 and 16. The steps 14–16 are restrained from movement in a vertical direction by means of screws 18 as shown in FIG. 1A while the side rails 12 and 13 may be pivoted by at least a 90 degree angle to point the tips of the hook portion 12A and 13A together for storage.

Engaging the lower end of the side rails 12 and 13 are standoffs 20 and 20B which are extended by opening hooks. The standoffs 20 and 20B insure that the rigid ladder portion is maintained away from the structure H, thereby insuring good clearance between the inner side of each tread 14 through 16 and the outer surface of the structre H. The user's toes may then extend inward for a solid foot placement on the treads during descent. The steps 14–16 are preferably of molded plastic such as polyethylene having sufficient strength to support a 250 pound person rapidly descending a ladder.

Figure 1A:
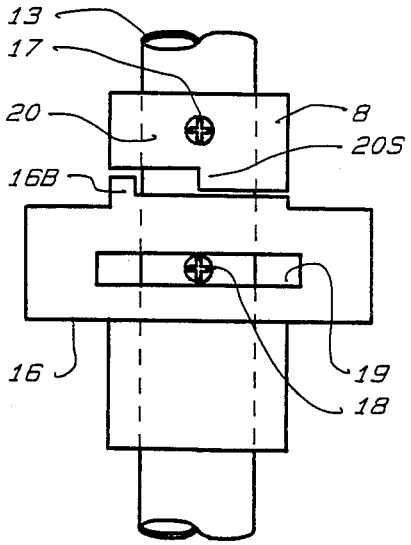
FIG. 1A is a fragmentary side elevational view of the step detail of this invention.

Now referring to FIG. 1A, the detail for the rotation of the side rails 12 and 13 is illustrated particularly with respect to step 16 and standoff 20. The standoff 20 in the form of a peg with a circular boss surrounding tube 13 is secured to the tube by screw 17 and turns with the tube 13 at all times. The circular boss B of standoff 20 includes an integral stop 20S. That stop engages a corresponding boss 16B on step 16. This allows the tube 13 to turn in one direction. Step 16 is secured to the tube 13 by a screw 18 riding in a slot 19. The screw 18 extends into tube 13 and its head provides support for step 16. The slot 19 allows the tube 13 to turn while maintaining the longitudinal position of the step 16 on the rod 13. Comparable standoffs 20 and the opposite end of step 16 are located on tube 12 and operate in the same mannner, only allowing tube 12 to rotate in the opposite direction to assume a folded position as is illustrated in FIGS. 3–6.

Figure 10:
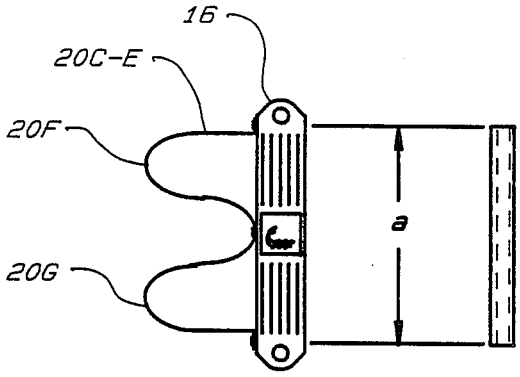
FIG. 10 is a vertical section view taken along line 10—10 of FIG. 2 showing the relative lengths of spacer to distance between tread rope holes.

The standoffs 20 may be a pair of rods for the rigid upper part of a ladder, or in the embodiment shown in FIG. 10, a flexible plastic strap secured to its ends and center by bolts or other fastening devices to define a pair of loops 20A and 20B as seen in FIG. 10 for the lower flexible part of the ladder, a flexible plastic strap secured at its ends and center by bolts or other fastening devices to define a pair of loops 20F and 20G as seen in FIG. 10, providing a degree of flexible standoff capability for the ladder.

A flexible support member, for example a rope 21, extends down through the interior of the hollow rails 12 and 13 with ends secured either within the side rails 12 and 13 or by a knot as shown in FIG. 2. The rope 21 extends beyond the lower end of the rigid side rails 12 and 13, and defines the lower flexible portion of the ladder. This lower portion of the ladder is formed by a plurality of steps 24–26 and 30–33. The number of steps is optional however we have found that for most two story residences, nine additional steps below the rigid steps is adequate to bring the party from the second floor within safe distance of the ground. Each of the steps 24–26 and 30–33 are separated by respective spacers 24A or 24B below step 24 and similarly identified spacers for the succeeding steps. The spacers are hollow tubes having diameters greater than the openings in the steps through which the rope 21 passes. This is best illustrated in FIG. 9 to which reference is now made.

Figure 9:
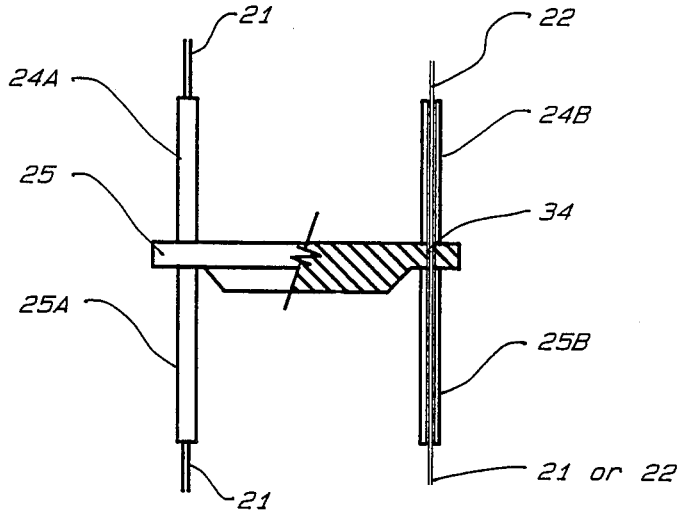
FIG. 9 is a fragmentary elevational view partly in section, showing the interrelationship of the stair treads, spacers and support beams.

In FIG. 9, step 25 is shown with spacers 24A and 24B above it. Spacer 24B is shown to be hollow and of larger diameter than the opening 34 in step 25. Therefore, the bottom edge of spacer 24B rests on the upper surface of step 25. Similarly the upper surfaces of spacers 25A and B rest on the lower surface of step 25 surrounding the opening 34 and its comparable opening at its opposite end of step 25. The rope 21 extends through the spacers and the steps on one side, under the lowermost step 33 and up through the other side and tnrough rail 13. The lowermost step 33 does not include any spacers however the rope 21 may be terminated below that step by a knot and a similar rope 22 support the opposite side or as illustrated in FIG. 1, ls form a continuous rope and return path of rope 21 to actually take the place of rope 22. The length of spacers 24A, B etc. is substantially equal in length to the distance between the openings 24-26 OP, 30-35 OP to allow ease of folding.

An important aspect of this invention is that the upper portion of the ladder is rigid to the user at all times once it is place on the window sill and the lower portion becomes rigidified as soon as the user places his weight on step 24. His weight is transmitted downward from step 24 to the spacers 24A and B, to step 25, spacers 25A and B and continuously to the bottom step 33. To the user, the ladder is then relatively rigid although it does allow some freedom of movement around obstructions which may be present below the sill 11.

Alternate steps 25, 30 and 32 each include a fixed standoff 20 C-E to the rotating standoffs 20A and B. Therefore, the remainder or the flexible portion of the ladder has the same property of being spaced away from the structure 12 on descent.

Referring now to FIGS. 3–6, wherein the foldability of the ladder is demonstrated FIG. 1 A is a fragmentary side elevational view of the step detail.

Figure 3:
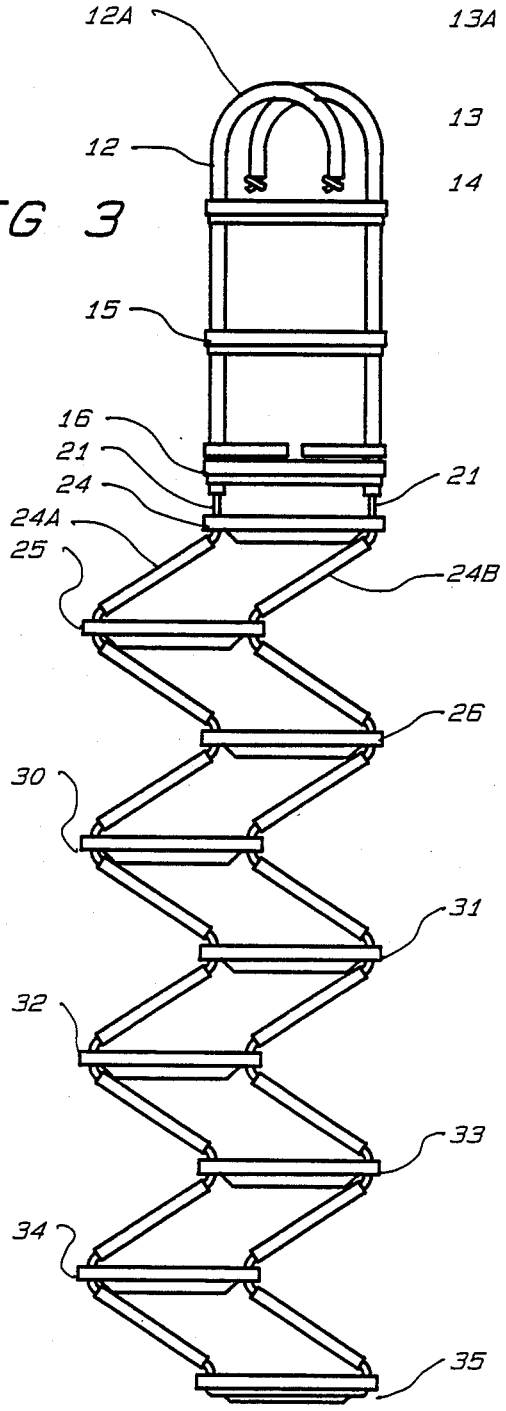
FIG. 3 is a front elevational view of the ladder of FIG. 1 in the process of being folded for storage.

The foldability of this invention is best illustrated in FIGS. 3–6. Referring now to FIG. 3 specifically, the side rails 12 and 13 are shown rotated by 90 degrees with the two inverted "J" shaped arms 12A and 13A in side by side position and the two standoffs 20 pivoted inward into near touching engagement. The steps 14–16 remain at fixed height by reason of the detail illustrated in FIG. 1A.

Figure 4:
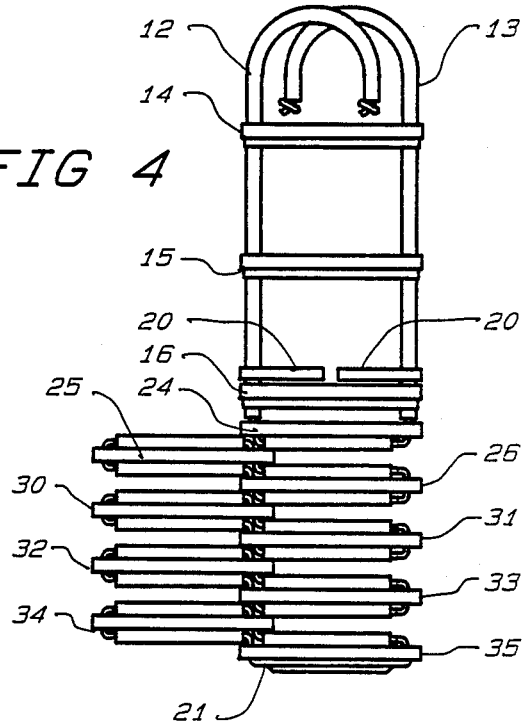
FIG. 4 is an elevational view of the ladder of FIG. 3 in the next stage of storage.
Figure 5:
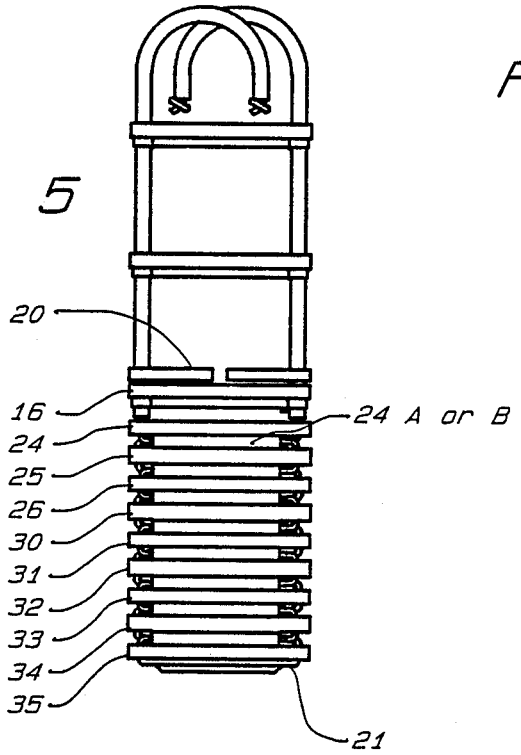
FIG. 5 is a front elevational view of the ladder of FIG. 1 in the next succeeding stage of storage.
Figure 6:
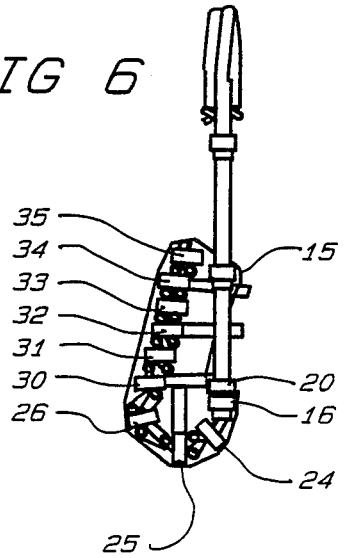
FIG. 6 is a side elevational view of the ladder of FIG. 1 in the next succeeding stage of storage.
Figure 7:
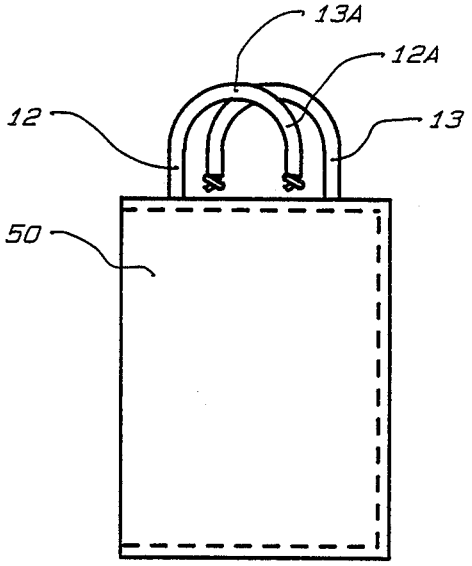
FIG. 7 is a front elevational view of the ladder of FIG. 1 stored in an enclosing bag.
Figure 8:
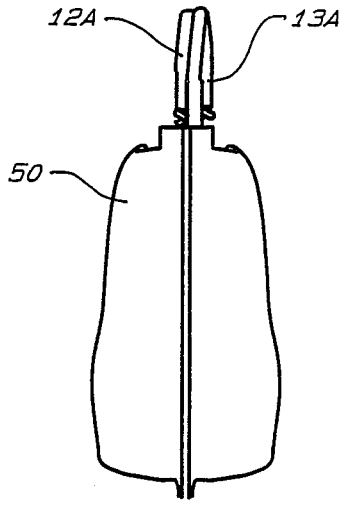
FIG. 8 is a side elevational view of the ladder as shown in FIG. 7.

Note that with no weight on the lower steps 24–26 and 30–33, the rope 21 utilizes flexibility and alternate steps may be moved sideward by the full length of the spacers such as spacers 24A and 24B. The lower sections of the ladder may then be compressed as shown in FIG. 4 with steps 25, 30, 32 and 34 extending to the left and steps 24, 26, 31 33 and 35 temporarily aligned with the rails 12 and 13. Next, as illustrated in FIGS. 5 and 6, the offset steps to the left, namely steps 25, 30, 32, 24 are folded back over to be in alignment with the aligned steps 24, 26, 31, 33 and 35 and then the folded steps further folded upward into the openings between the steps 15 and 16 or if necessary, between steps 14 and 15. The hooks 12A and 13A are clearly shown as folded. The entire assembly may be then slid into a bag 50 as illustrated in FIGS. 7 and 8. A strap such as 2" by 44" webbing with velcro may be used as shown in FIG. 6 to prevent steps from unfolding until desired. Preferably, the bag 50 has a fold at one side and velcro or other hook and pile type fastener on two sides to allow easy and rapid opening of the bag when in use. Note that the bag 50 allows the side rails 12 and 13 to extend out of the top so that the hook portions 12A and 13A may be used in handles. The fact that the upper portion of the ladder is rigid (except for the pivoting of the side rails 12 and 13) means that the entire assembly, when in the bag, is relatively rigid and can easily be handled by adult or child to pull the ladder from a closet or out from under a bed, tear off the cover, pivot the side rails and hook them over a sill of an open window and release the strap while releasing the flexible steps. The ladder is of such simplicity that detailed instructions are not necessary and the side rails, particularly the hook portion, provide effective handles in the storage, removal from storage and placement of the escape ladder.

Figure 11:
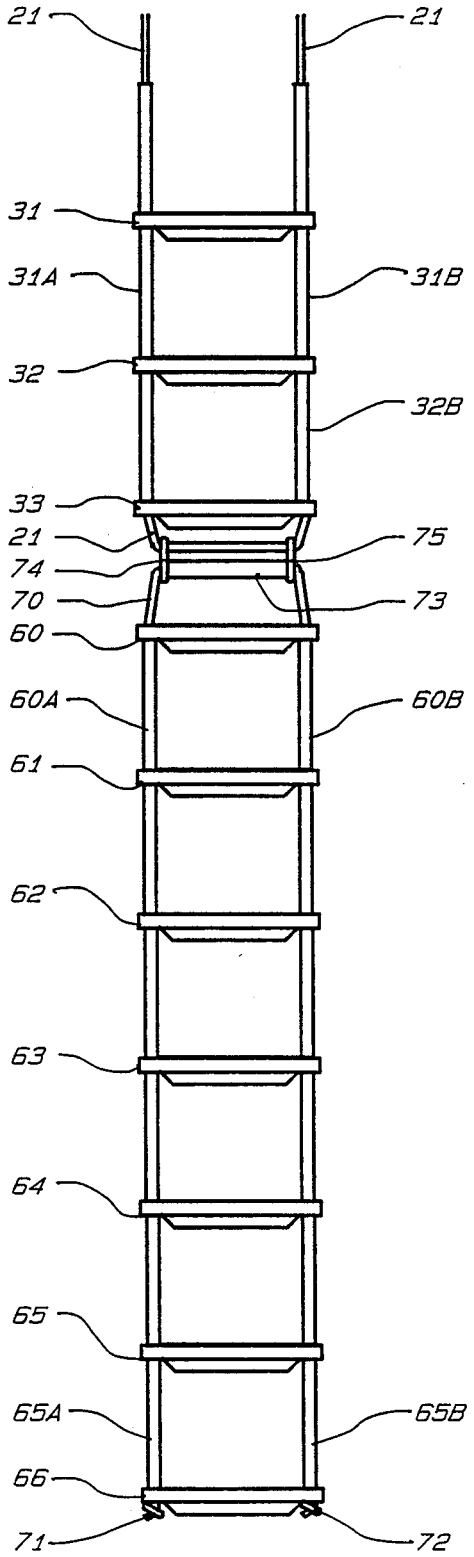
FIG. 11 is a fragmentary vertical sectional view of an alternate embodiment of this invention for multiple level houses.
Figure 12:
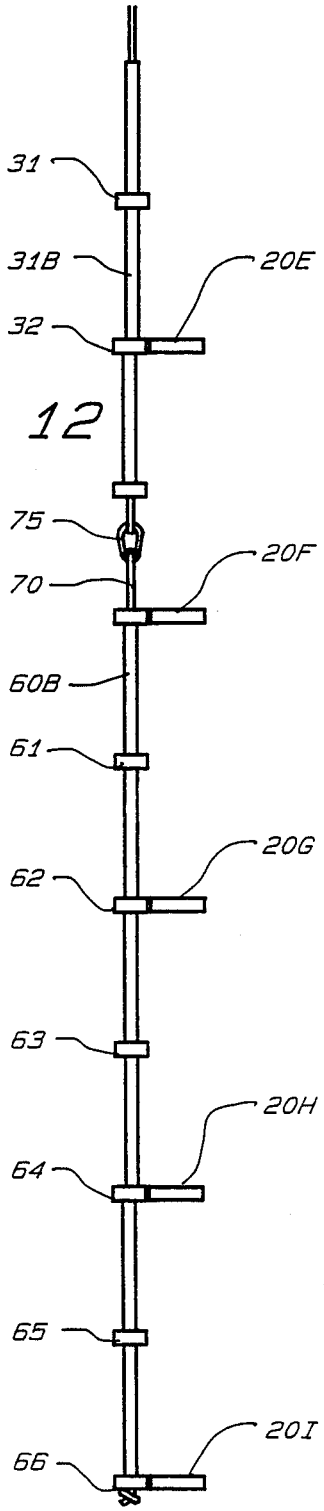
FIG. 12 is a fragmentary side elevational view of the embodiment of FIG. 11.

The adaptability to multi storied buildings is illustrated in FIGS. 11 and 12. This is particularly designed where a single rope 21 is used as in the embodiment of FIG. 1. It should be noted that the rope 21 extends across the lower tread 33 before it returns through the right hand tubes such as 32B and 31B to the inverted "J" hook 13 of FIG. 1. A third set of steps 60–66 are all supported on a rope 70 having a first knot 71 beneath step 66 at spacer 65A and a second knot 72 beneath step 66 adjacent to spacer 65B. The rope 70 at its upper end, passes through a similar spacer 73 and has snapring or carbinner 74 and 75 at opposite ends of the spacer 73. This spacer 73 keeps the two carbinners 74 and 75 spaced so that they create hand holds on either side of the treads and aid in stabilizing the lower section of the ladder. This third set of stairs rigidifies as soon as the user places his weight on step 60 and climbs to the ground. As may be seen in FIG. 12, the lower section is spaced from the building by a similar series of spacer members 20F through 20I.

In the preferred embodiment of this invention, we have found the following to be preferred:

| | |
|---|---|
| Side rail length | 36 inch |
| "J" hook throat | 9.5 inch |
| Aluminum tubing | 1 inch diameter |
| | .062 wall thickness |
| Step tread length | 12 inches |
| Spacer length | 12½ inch |
| width | 2½ inch |
| Number of steps | 3 rigid |
| | 9 folding |
| Overall length - 2 story model | 13 feet |
| 3 story model | 23 feet with extension |

This invention shall not be limited to the illustrative embodiment but rather to the claims as set forth below which constitutes definitions of this invention including the protection afforded by the doctrine of equivalents.

What is claimed is:

1. A safety ladder, particularly for a two or more story structure, comprising a pair of inverted "J" shaped arms of rigid material constituting side rails for said safety ladder having a base of the "J" of such sufficient transverse dimension that it will fit over the sill portion sufficient to support at least two steps therebetween;

a first set of at least two steps secured to said side rails to define a rigid ladder portion;

a second set of steps, each having a pair of openings therethrough to allow the passage of flexible support means;

a pair of flexible support means secured respectively to said side rails and extending beyond the end of said extending portions;

said flexible support means passing through the openings in said steps;

a plurality of rigid spacer means on said flexible support means between adjacent steps whereby at least the first two steps are rigid with respect to the side rails and remaining additional steps are maintained relatively rigid with respect to the flexible support means upon the application of the weight of the user to the uppermost of said set of steps located on said flexible support means.

2. The combination in accordance with claim 1 wherein the openings in said second set of steps sufficient to allow the passage of the flexible support means therethough are of small enough size to prevent the passage of said spacer means therethrough whereby said spacer means are located by said flexible support means and bear against respective lower and upper surfaces of adjacent steps to provide a relatively rigid support.

3. The combination in accordance with claim 1 wherein said spacer means comprise tubes.

4. The combination in accordance with claim 1 wherein said first set of steps are at least three in number.

5. The combination in accordance with claim 1 wherein said second set of steps are greater in number than said first set of steps.

6. The combination in accordance with claim 1 wherein said side rails are hollow tubing and said flexible support means extend through said hollow tubing.

7. The combination in accordance with claim 1 wherein said flexible support means constitutes a rope.

8. The combination in accordance with claim 1 wherein said spacer means have a length equal to the spacing between said openings in respective steps whereby said spacer means and steps may be folded into a compact assembly when not in use.

9. The combination in accordance with claim 1 including enclosure means for storing said ladder when not in use;

said storage means having a width sufficient to receive the rigid assembly of the side rails and first set ot steps as well as a thickness sufficient to receive the spacer means and steps when folded together.

10. The combination in accordance with claim 9 wherein said enclosure comprises a bag.

11. A safety ladder for use in multistory structures comprising:

a pair of side rails including a pair of integral end hooks dimensioned to fit over a window sill;

said side rails including generally straight portions extending below said end hooks when said end hooks are placed over a window sill with the straight portions at the exterior or the structure;

the straight portions of said side rails mounting a first plurality of steps in fixed relationship to each of the other of said steps;

flexible support means extending below said side rails;

said flexible support means carrying a second plurality of steps;

spacer means between each of said second plurality of steps;

said spacer means transferring the load of each of said second plurality of steps to lower steps to rigidify said second plurality of steps upon the application of the weight of a user to any of said second plurality of steps.

12. A safety ladder in accordance with claim 11 wherein said flexible support means comprises a rope.

13. A safety ladder in accordance with claim 12 wherein said side rails are hollow and said rope passes through said side rails for support therefrom.

14. A safety ladder in accordance with claim 12 in which said rope passes through said spacers and steps and beneath the loweremost of said second plurality of steps.

15. A safety ladder in accordance with claim 14 including a second flexible support means;

means for engaging said second flexible support means with said rope beneath the lowermost of said second plurality of steps;

a third plurality of steps supported by said second flexible support means providing an extension for said escape ladder.

* * * * *